US008138870B2

(12) United States Patent
Hasel et al.

(10) Patent No.: US 8,138,870 B2
(45) Date of Patent: Mar. 20, 2012

(54) SOLENOID AND ACTUATING ELEMENT WITH SOLENOID

(75) Inventors: Claus-Peter J. Hasel, Memmingen (DE); Florian J. Rauch, Bad Grönenbach (DE); Peter J. Tappe, Memmingen (DE)

(73) Assignee: SVM Schultz Verwaltungs-GmbH & Co. KG, Memmingen (DE)

( * ) Notice: Subject to any disclaimer, the term of this patent is extended or adjusted under 35 U.S.C. 154(b) by 127 days.

(21) Appl. No.: 12/588,479

(22) Filed: Oct. 16, 2009

(65) Prior Publication Data

US 2010/0097166 A1 Apr. 22, 2010

(30) Foreign Application Priority Data

Oct. 16, 2008 (DE) ..... 10 2008 051 900

(51) Int. Cl.
*H01F 7/08* (2006.01)

(52) U.S. Cl. ..... 335/238; 335/219; 335/220; 335/261; 335/279

(58) Field of Classification Search ..... 335/219–282
See application file for complete search history.

(56) References Cited

U.S. PATENT DOCUMENTS

| | | | | | |
|---|---|---|---|---|---|
| 2,255,542 | A * | 9/1941 | Ehrlich | 335/265 |
| 2,362,151 | A * | 11/1944 | Ostenberg | 290/1 R |
| 2,668,412 | A * | 2/1954 | Abramson | 60/786 |
| 2,870,675 | A * | 1/1959 | Salisbury | 89/1.1 |
| 2,889,776 | A * | 6/1959 | Gunther | 102/209 |
| 3,535,590 | A * | 10/1970 | Mayer | 361/45 |
| 3,762,087 | A * | 10/1973 | Strubin | 42/84 |
| 4,319,168 | A * | 3/1982 | Kemeny | 318/135 |
| 4,347,463 | A * | 8/1982 | Kemeny et al. | 318/135 |
| 4,510,935 | A * | 4/1985 | Spencer | 607/5 |
| 5,059,839 | A * | 10/1991 | Rose et al. | 310/10 |
| 6,431,071 | B1 * | 8/2002 | Hodge et al. | 102/254 |
| 7,111,619 | B2 * | 9/2006 | Schneider | 124/8 |
| 2001/0048362 | A1 * | 12/2001 | Spencer | 340/425.5 |
| 2009/0090334 | A1 * | 4/2009 | Hyde et al. | 123/51 R |

* cited by examiner

*Primary Examiner* — Mohamad Musleh
(74) *Attorney, Agent, or Firm* — Jacobson Holman PLLC

(57) ABSTRACT

A solenoid with a coil which can be current-fed, the resulting magnetic field moving an armature. The armature acts, if necessary, on an actuator. Furthermore, the solenoid has at least one pyrotechnic actuation for the armature or the actuator.

10 Claims, 3 Drawing Sheets

SOLENOID AND ACTUATING ELEMENT WITH SOLENOID

Figure 1A:
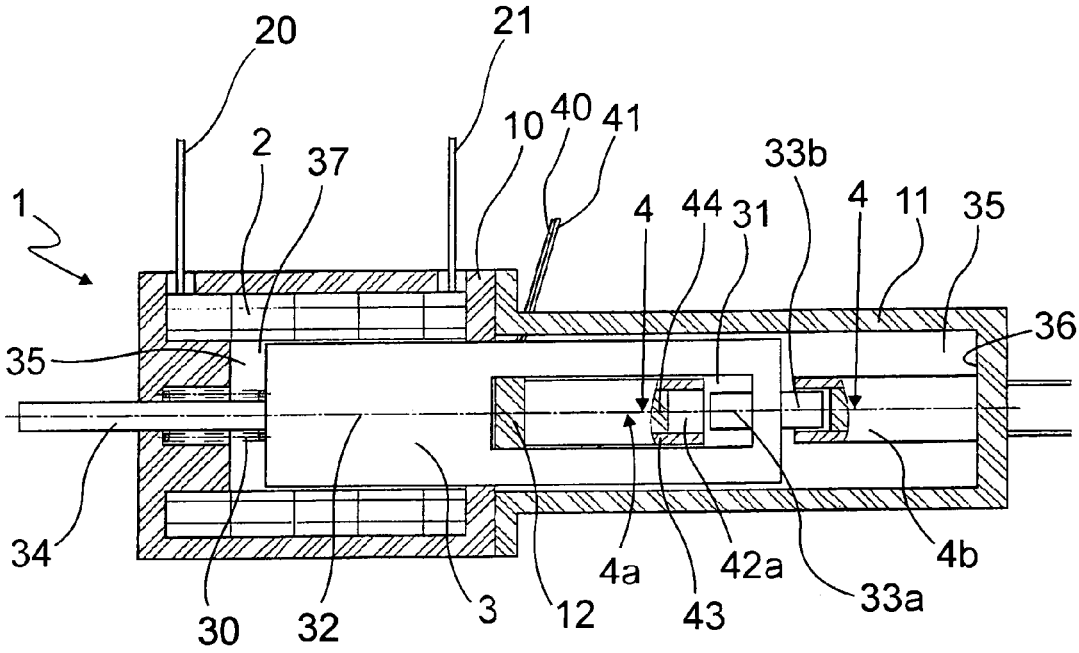

The invention refers to a solenoid with a coil which can be current-fed, the resulting magnetic field moving an armature. The armature acts on an actuator. The invention furthermore refers to an actuating device comprising a solenoid having a coil which can be current-fed and the resulting magnetic field moving an armature, and the armature acting on an actuating element of the actuating device.

BACKGROUND OF THE INVENTION

Solenoids of this type are often part of a more complex actuating device. By means of the solenoid here different positions of the actuating device are set, for example a locking is generated or the like. The solenoid has here a coil which can be current-fed, the coil having here a suitable wire winding which can be flown through by current. The magnetic field thus generated here acts on an armature which is arranged moving in the armature space of the solenoid and which can be magnetized, and the armature is moved according to the resulting magnetic field.

Here simple switch magnets which attract the armature against a spring force are comprised in the same way by the invention as also more complex reverse lifting magnets where, for example, two coils arranged one behind the other generate opposing magnetic fields and move the armature between two different positions back and forth. In this respect the invention is not restricted to a particular type of a solenoid.

Usually the armature acts on an actuator of the solenoid, for example an armature rod or the like. Depending of the design here the actuator is connected rigidly with the armature or the armature acts in a suitable way on a separate actuator arranged movable relative to the armature.

In the use of the solenoid in an actuating device, as it is also described and claimed in this invention, the armature eventually acts on an actuating element of the actuating device. In order to realize this there are several ideas. First of all, it is possible that the actuating element of the actuating device is identical with the actuator of the solenoid, that is, for example, the armature rod operates a suitable bar or the like in the actuating device. However, again the invention is not restricted in this respect, there are also cases of employment where the armature or the actuator (for example armature rod) of the magnet acts on a separately provided actuating element of the actuating device. The actuating element may be, for example, a bar, if, for example, the actuating device is designed as locking device or the like.

The circuit speed, that is the period of time required to bring the solenoid or the actuating device from a first position to a second position, depends decisively on the magnetic qualities of the used components, the size of the coil, the load independent current of the coil and so on. When the current of the coil is switched off the magnetic field of the coil is not abruptly reduced, either, but runs out exponentially. The running-out magnetic force still acts against the spring force which actually would push back the armature.

The result are circuit times which may be several 100 ms. However, in emergency situations a clearly shorter circuit time is required.

BRIEF ABSTRACT OF THE INVENTION

It is an object of the invention to improve the state of the art in that way that a switching of a solenoid or an actuating device as described as fast as possible is carried out.

In order to solve this problem the invention refers to a solenoid as described in the beginning and suggests that in the solenoid at least one pyrotechnic actuation for the armature or the actuator is provided.

A pyrotechnic actuation is a drive based on the pyrotechnic effect. By means of igniting a pyrotechnic set here another object (for example a driving element) is accelerated or moved, that means driven.

The pyrotechnic set here is a material or a mix of materials with the purpose to develop for example a mechanic effect (pressure or movement). It contains at least one oxidant and one fuel. The pyrotechnic sets are the carriers of the chemical functions of the pyrotechnic actuation. The pyrotechnic actuation is triggered by a control command via a trip line acting on an ignitor and causing a (small) explosion of the pyrotechnic set. The pyrotechnic set here acts on a suitable driving element, for example a drive piston or the like. The pyrotechnic set brings this driving element from a first inoperative position to a second, activated position.

The essential advantage of the invention is that by the use of the pyrotechnic actuation the armature or the actuator can be moved in the respectively desired position in a very short period of time. The advantage is here that there are very small pyrotechnic actuations which are nevertheless able to realize circuit times of less than 10 ms, for example typically less than 5 ms.

The invention here does not only comprise the improvement of the solenoid as described in the beginning, but the invention comprises also an actuating device as described in the beginning where a pyrotechnic actuation is provided which acts, if necessary, additionally on the actuating element and accelerates it.

The pyrotechnic actuation is not restricted to the application or arrangement in the solenoid described according to the invention. The same result, namely a clear acceleration of the circuit times or the increasing of the circuit speed is also achieved when the pyrotechnic actuation acts on the actuating element of the actuating device, that is the elements which are not compulsorily connected basically with the solenoid but are operated by it. Therefore the invention makes it possible to reach according to the suggestion according to the invention a considerable reduction of the circuit times along the entire active path in the actuating device, that is starting with the moving armature, if necessary via the actuator or the actuating element, and, if necessary even other actuating elements such as bars and so on. Usually here the pyrotechnic actuation is only employed when needed, that is for example with corresponding critical conditions, the usual operation of the actuating element is carried out by the switching movement of the armature of the solenoid. It is, of course, not excluded that the solenoid according to the invention or the actuating device according to the invention has several pyrotechnic actuations acting in the same way, in order to be able for example to carry out a certain quick switching several times one after the other. Cleverly this is monitored by the control of the solenoid or of the actuating device in order to actuate then the pyrotechnic actuation which is not yet used.

In a preferred embodiment of the invention it is provided that the pyrotechnic actuation is arranged on or in the armature, or on or in the actuator. Thus it is possible to realize an arrangement of the pyrotechnic actuation in the solenoid according to the invention as space saving as possible. It is also possible for service and maintenance purposes to change the complete solenoid together with the pyrotechnic actuation so that the expenses for servicing are kept low.

For the arrangement of the pyrotechnic actuation on or in the armature, or on or in the actuator there is a number of modifications. In a first modification it is suggested here that in the armature or actuator a recess is provided in which the pyrotechnic actuation is arranged, and the armature or the actuator moves relative to the pyrotechnic actuator by current-feeding the coil. The recess can be realised in this embodiment as longitudinal hole, and moves therefore relatively to the stationary pyrotechnic actuation. In a suitable way, however, the pyrotechnic actuation then interacts with an element on the actuator or armature, if, namely, this has to be moved accordingly.

Besides the modification, where the pyrotechnic actuation is stationary relative to the armature, there is, of course, also the modification that, according to the invention, the pyrotechnic actuation moves together with the armature or the actuator. Here the driving element of the pyrotechnic actuation driven by the pyrotechnic set is supported in a suitable way relatively to an element stationary relative to the solenoid (for example the armature space floor or the like).

In the stationary modification it is provided according to the invention that the pyrotechnic actuation is supported by the housing of the solenoid or the coil form of the solenoid. The housing of the solenoid here comprises all parts of the solenoid connected with the housing. These parts can, however, carry out even other functions, such as, for example, forming a pipe section in the armature space or the like. In this respect the term "housing" can be understood very generally, and is not to be restricted to the exterior elements of the solenoid.

Furthermore, it is possible that the pyrotechnic actuation is arranged in the armature space floor to which the armature may be in contact, and thus acts on the armature or the actuator.

In a preferred embodiment of the invention it is suggested that the pyrotechnic actuation acts as centrally as possible relative to the armature or the actuator. Thus jamming of the armature on its running path in the solenoid or the actuator on its running path shall be prevented. It has namely to be taken into consideration that the forces of the pyrotechnic actuation acting on the armature may be clearly bigger than the magnetic forces by switching-on the current by the coil. By the effect as centrally as possible of the driving force of the pyrotechnic actuation on the armature or the actuator a conversion as reliable as possible of the desired fast change of positions of the solenoid or even the actuator is reached according to the invention.

For the design of the pyrotechnic actuation in the following two examples are mentioned according to the invention, without restricting, however, the invention to these examples.

In the first example it is provided that the pyrotechnic actuation has a sleeve in which a drive piston is arranged which can be moved by the pyrotechnic set of the pyrotechnic actuation, and which is provided in the not-activated position of the pyrotechnic actuation in front of the driving piston an immersion space is provided in the sleeve.

The pyrotechnic set comprises in addition to the abruptly letting-off material or material mixture also an ignitor which cleverly is actuated electrically or electronically. The pyrotechnic set acts according to the invention on a suitable driving element, such as for example a suitable driving piston. The design of the pyrotechnic actuation is altogether chosen in such a way that the moving path of the driving piston is defined exactly. This is reached by a suitable design of the pyrotechnic actuation, in particular its sleeve and the like. According to the invention it is namely suggested that in the not-released position of the pyrotechnic actuation in the sleeve in front of the driving piston an immersion space is provided. This space, only a couple of mm or cm long, defines the maximum path of the driving piston. This guarantees that the driving piston does not leave the housing or the exterior dimensions of the housing of the pyrotechnic actuation.

In another modification according to the invention the pyrotechnic actuation consists of two concentrically, radially spaced pipe parts between which a preferably annular driving piston is provided which can be moved by the pyrotechnic set of the pyrotechnic actuation, and an immersion space is provided in the not-released position of the pyrotechnic actuation between the two pipe parts in front of the driving piston. At the end of the head of the pyrotechnic actuator or its housing therefore an annular immersion space results. Therefore the arrangement is chosen in such a way that the driving piston, after igniting the pyrotechnic actuation, does not leave the housing or its exterior dimensions.

Furthermore it is provided in a modification according to the invention that in or on the armature or the actuator at the recess or in the armature space floor a mandrel is provided which is able to immerse temporarily in the immersion space when the solenoid is operated as usual.

The design of the mandrel is such that it has a slightly smaller diameter than the width of the immersion space. In the case that an annular immersion space is provided the mandrel has a design like a pipe segment.

The arrangement is chosen here in such a way that, when the electromagnet is operated as usual, this mandrel can immerse at least temporarily in the immersion space of the pyrotechnic actuation. As described the driving piston driven by the pyrotechnic set acts only along the length or depth of the immersion space, and it also can only in this area be supported or pushed back by the armature, the actuator, in the recess or in the armature space floor. Cleverly here the position of immersion of the mandrel in the immersion space is assigned to the switching position of the solenoid or the actuating device, namely the one which is to be released if necessary abruptly, very fast.

In a preferred embodiment of the invention it is provided that for activating the pyrotechnic actuation at least one trip line is provided at the pyrotechnic actuation. For the movement of the armature in the solenoid a control is provided which accordingly current-feeds the current windings of the coil, that is it switches the current on and off. If a corresponding position results which requires the use of the pyrotechnic actuation the control activates via the trip line(s) the pyrotechnic actuation. As already described the pyrotechnic actuation comprises for that, for example, an electrically operating ignitor which detonates the pyrotechnic set, that is the explosive material mixture, and thus brings the piston out of its inoperative position in its final position, preferably within the limits of the housing of the pyrotechnic actuation.

Cleverly the control is responsible for, that means it controls, also the flow of current through the coil (that means the winding of the coil).

Usually the pyrotechnic actuation is employed in suitable special switch positions of the solenoid, and usually the result is that the solenoid should not be used for other switching operations. In order to prevent later reliably corresponding switch positions, in a modification according to the invention it is suggested that after activating the pyrotechnic actuation another current-feeding of the coil is not performed. In the case that several identically acting pyrotechnic actuations are provided in the solenoid according to the invention, another current-feeding of the coil by the control is not carried out when, for example, all pyrotechnic actuations are used up, that means they are ignited and cannot be used.

It is clear that the activation of the pyrotechnic actuation by a trip line can be realised accordingly also in an actuating device suggested according to the invention in a modification according to the invention, and the method described in connection with the solenoid acts in the same way also with the operation of an actuating device. In the actuating device according to the invention it is also an advantage that, after activating the pyrotechnic actuation, another current-feeding of the coil of the solenoid arranged in the actuating device is not performed by the control. In the same way, of course, the control realises, if several pyrotechnic actuations acting in the same way are available, that, if necessary, the not-triggered pyrotechnic actuation is activated, and then another current-feeding of the coil by the control is stopped only when there is no other unused pyrotechnic actuation available.

The invention comprises in particular also a method for operating a solenoid as described or an actuating device as also described, wherein after an activation of the pyrotechnic actuation another current-feeding of the coil is interrupted. In particular, current-feeding of the coil is interrupted when the last pyrotechnic actuation has been activated. By such a method, which can be realised, for example, with a control, a considerable improvement of security has been reached as by means of that no fault positions of the solenoid or of the actuating device can occur, and, in particular, no attracted position of the solenoid is available, that means eventually the solenoid cannot be used properly anymore.

Cleverly it is provided that the active direction of the pyrotechnic actuation is opposing the direction of movement of the armature moved by the magnetic field of the coil.

Often the suggestion according to the invention is used in order to remove the armature abruptly from its attracted position. In this case, the active direction of the pyrotechnic actuation is opposing the direction of movement of the armature moved by the magnetic field of the coil. Just when the armature is released, when the exciting current through the coil is switched off, a rather slow restoring movement of the armature occurs which is improved considerably by the use according to the invention.

In a preferred modification of the invention it is provided that the pyrotechnic actuation is arranged in the armature space, laterally beside the moving armature. It is possible that the pyrotechnic actuation acts indirectly on the armature, for example a suitable lever mechanism or the like is provided. It is then possible that the pyrotechnic actuation does not act centrally on the armature but is arranged laterally beside the armature. For the arrangement of the pyrotechnic actuation there is a number of variants.

However, the invention also comprises solutions where in the solenoid two pyrotechnic actuations are provided the respective active directions of which are opposing.

Thus it is possible according to the invention to select all of a sudden different positions of the solenoid and thus to make a very fast reaction opportunity possible. It is basically also possible here that the two pyrotechnic actuations are activated one after the other, the invention is not limited here.

In a preferred embodiment of the invention it is suggested that both pyrotechnic actuations are designed moving together with the armature or at least one of the pyrotechnic actuations is stationary relative to the armature in the solenoid. The arrangement of the pyrotechnic actuations in the solenoid is variable. The invention here comprises solutions where both pyrotechnic actuations move together with the armature, both pyrotechnic actuations are stationary in the solenoid, that is not moving together with the armature, or suitable mixed forms. It has, of course, to be taken into consideration that the invention also comprises solutions which comprise more than only two pyrotechnic actuations, which, however, may then be, if necessary, arranged into two (or even more) groups acting in the same way. Thus it is possible to realise at the solenoid at least a certain redundancy with regard to the application of the fast-acting pyrotechnic actuation.

In a advantageous embodiment of the invention it is suggested that the armature is located between the two pyrotechnic actuations. Such an embodiment is shown, for example, in FIGS. 3*a*, 3*b*, 3*c*. The two pyrotechnic actuations are designed here stationary relative to the armature in the solenoid. However, according to the invention, also a mixed form is, as designed above, comprised by it.

In another embodiment of the invention it is suggested that the armature acts on a first side on the actuator or is connected with it, and the two (or even more) pyrotechnic actuations are arranged on the back side of the armature opposing the first side. In this example the pyrotechnic actuations, preferably all, are arranged on one side which is in particular advantageous for cases of maintenance and assembly.

It has already been pointed out that the invention also refers to an actuating device consisting of a solenoid having a coil which can be current-feed. The magnetic field resulting from the coil moves an armature, and the armature acts on an actuating element of the actuating device.

According to the invention a pyrotechnic actuation is provided which acts, when required, additionally on the actuating element and moves it. The invention comprises a number of modifications where the pyrotechnic actuation is arranged at the actuating device according to the invention to act, when required, additionally on the actuating element. Eventually the actuating element, for example a bar or the like, can be brought from a first position abruptly in a second position, and the pyrotechnic actuation can engage directly at the actuating element, if necessary cleverly by suitable mass decoupling of the mass of the armature. By that the mass which has to be accelerated is reduced accordingly, and a faster acceleration, that means a faster movement of the actuating element is effected.

Thus it is suggested in a modification according to the invention that the pyrotechnic actuation acts indirectly or directly on the actuating element. An indirect action of the pyrotechnic actuation on the actuating element is reached, for example, by an arrangement of the pyrotechnic actuation in the solenoid where the armature or the armature rod/actuator is moved which then transfers the movement to the actuating element. As the actuating element is designed separately from the solenoid according to the invention an arrangement of the pyrotechnic actuation in the area of the actuating element is also suggested, that is outside the solenoid, what leads to the same result.

Cleverly in a modification according to the invention a solenoid, as described, is employed in the actuating device according to the invention.

In this connection it is in particular pointed out that all characteristics and features, but also all methods, described in connection with the solenoid or the actuating device are seen as transferable accordingly also with regard to the formulation of the method according to the invention, and are also seen, according to the invention, as employable and also disclosed. The same goes also vice versa, that means constructive, that is device characteristics only mentioned with regard to the method may also, in the frame of the claims for the solenoid or the actuating device, be considered and be claimed and also count as part of the invention and the disclosure.

BRIEF DESCRIPTION OF THE DIFFERENT VIEWS OF THE DRAWINGS

Figure 1B:
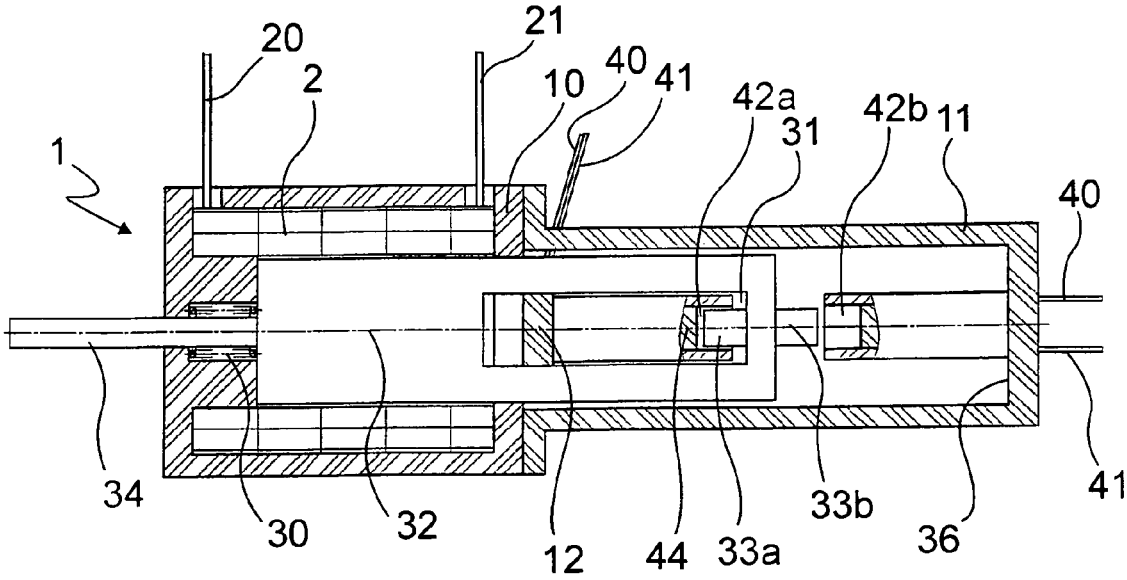
Figure 2A:
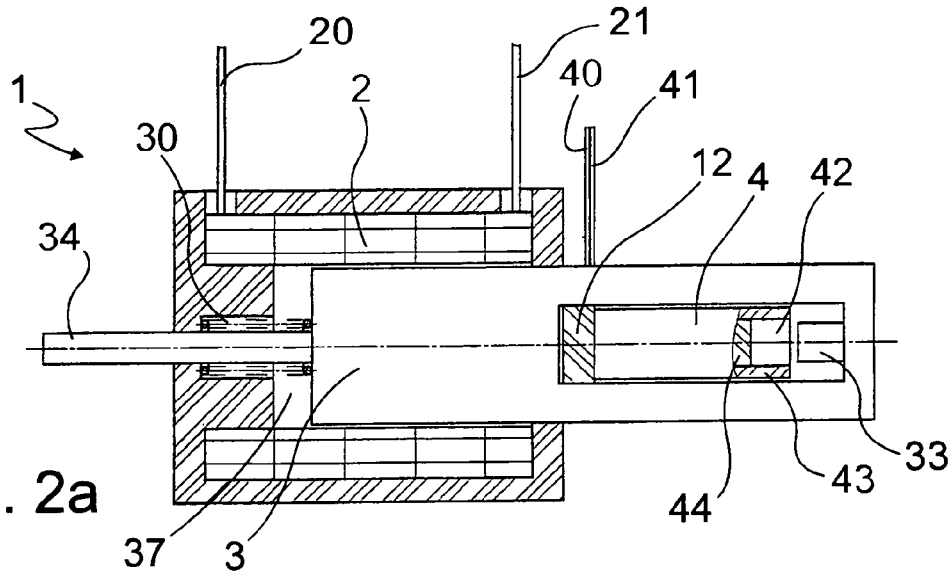
Figure 2B:
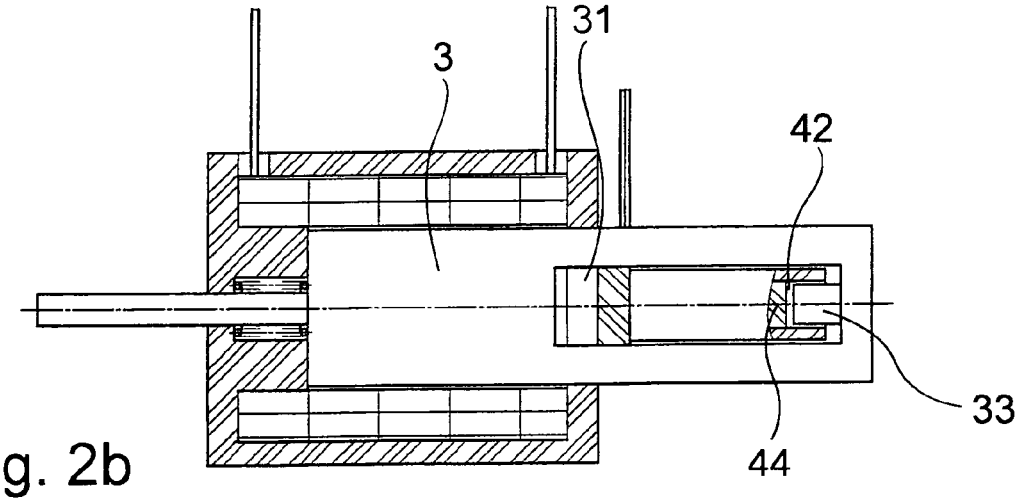
Figure 2C:
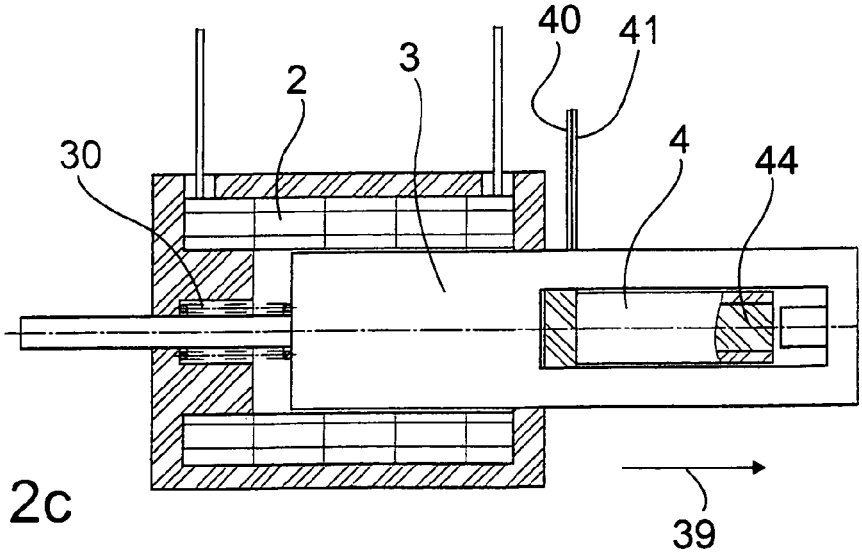
Figure 3A:
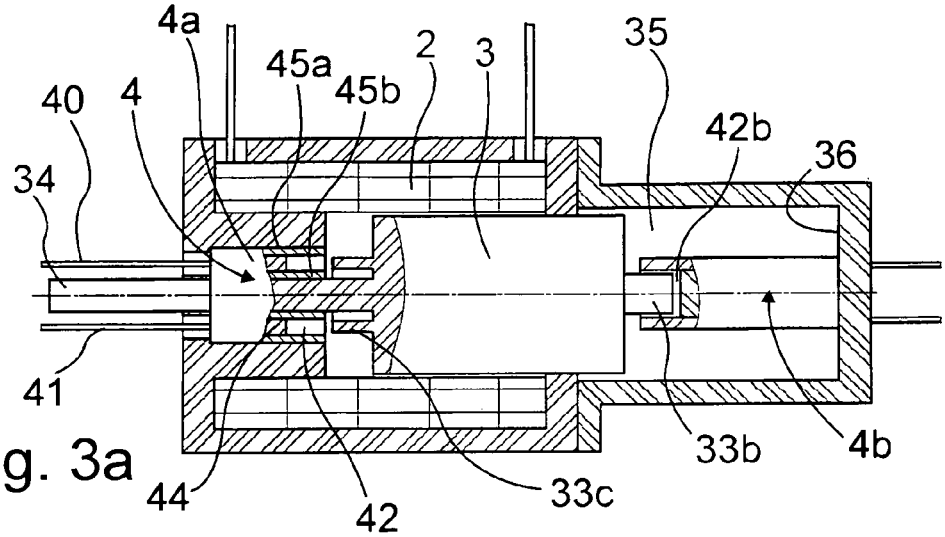
Figure 3B:
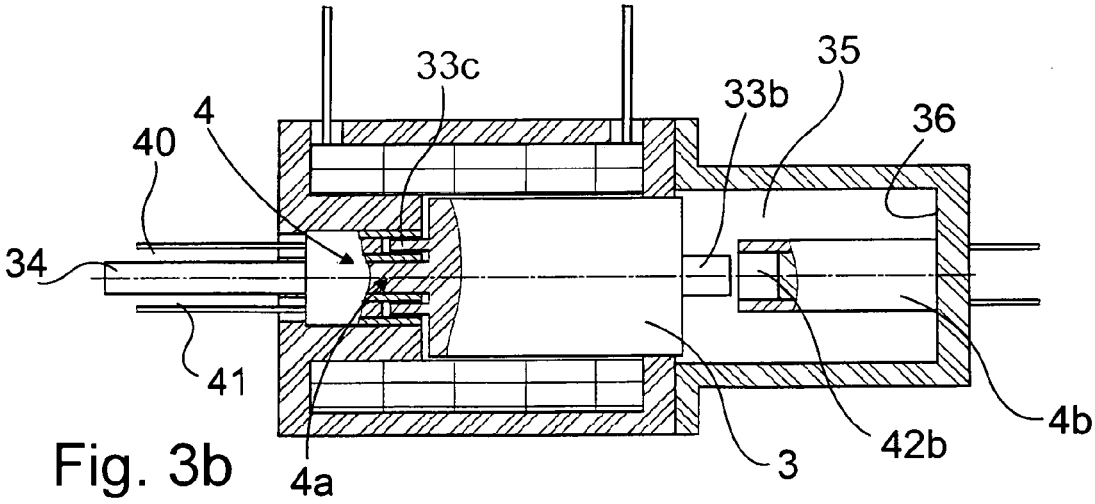
Figure 3C:
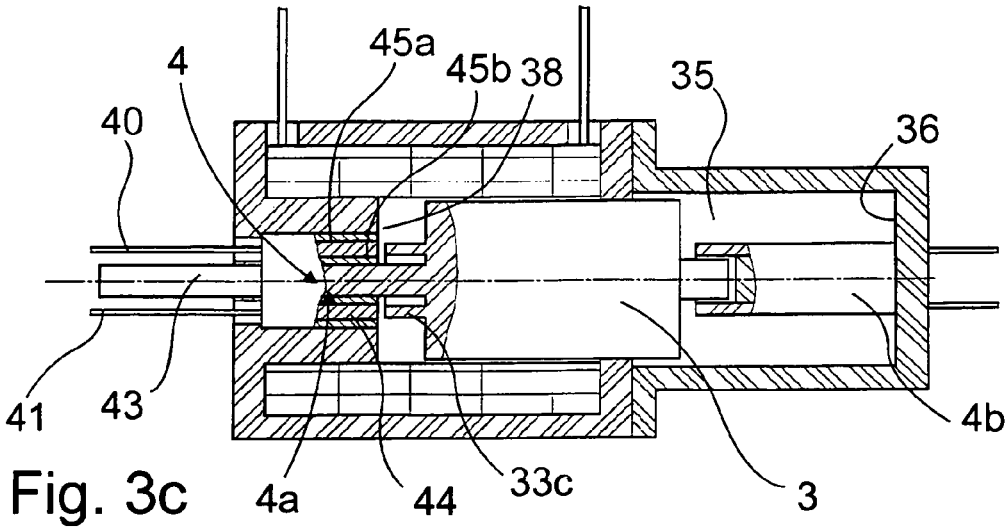

In the drawing several embodiments (not final) of the invention are shown schematically. In the figures:

FIGS. 1*a*, 1*b* Each in a section two different positions of a first embodiment of the solenoid according to the invention;

FIGS. 2*a*, 2*b*, 2*c* each a section of another embodiment according to the invention in three different positions and FIGS. 3*a*, 3*b*, 3*c* each a section of another, third embodiment of the solenoid according to the invention in different positions.

DETAILED DESCRIPTION OF THE PREFERRED EMBODIMENT

In FIGS. 1*a*, 1*b* a first embodiment of the solenoid 1 according to the invention is shown schematically. The difference between the drawings shown in the two FIGS. 1*a* and 1*b* is in the switch position of the solenoid.

The solenoid 1 comprises a coil 2 carrying a winding equipped with an electrically conductive wire. Supply and exit line of this winding are indicated by 20 and 21, respectively. The coil 2 is built rotational-symmetrically and encloses at least partly an armature space 35.

The magnetic field generated by the coil 2 because of the current conduction acts on the armature 3 in the armature space supported axially shifting and therefore supported movably.

In FIG. 1*a* the fallen condition of the solenoid 1 is shown as in the left hand area the air gap 37 is not closed, and the pull-back spring 30 shifts the armature 3 to the right.

If now, via the supply and exit line 20, 21 the winding of the coil 2 is current-fed, the developing magnetic field pulls the armature 3 against the power of the pull-back spring 30 to the left and thus bridges the air gap 37 in the armature space 35. This position is shown in FIG. 1*b*, at the left-sided end of the armature 3 an actuator 34, here an armature rod 34, is provided which, because of the movement of the armature 3 to the left, is also shifted to the left. It can be seen clearly that the pull-back spring 30 is compressed. The way of functioning of a solenoid described here is sufficiently known.

According to the invention the solenoid 1 is additionally equipped with a pyrotechnic actuation 4, 4*a*, 4*b* which acts in the embodiment shown here on the armature 3, however if necessary, also could act on the actuator or the armature rod 34. The invention also comprises the modification cited secondly.

In the case shown here in FIGS. 1*a*, 1*b* two pyrotechnic actuations 4, 4*a*, 4*b* are employed.

A first pyrotechnic actuation 4*a* is arranged in a recess 31 of the armature 3. On the right hand side beside the housing 10 of the solenoid receiving the coil 2 a closed pipe part 11 as part of the housing 10 is connected and widens the solenoid on the side of the solenoid 1 opposite to the driving rod/actuator 34. By means of the arrangement of the pipe part 11 the armature space 35 is enlarged considerably.

The recess 31 penetrates the armature 3 completely like an elongated hole in such a way that a yoke-like support 12 penetrates the recess 31. The support 12 is rigidly or fixedly connected with the pipe part 11 or (alternatively according to the invention) with the housing 10 of the solenoid 1.

On this support 12 the first pyrotechnic actuation 4*a* is arranged. The pyrotechnic set, which can be activated by the trip line 40, 41, is located on the left behind the driving piston 44, which in the non-activated position, as shown in FIGS. 1*a*, 1*b*, is built receding in a sleeve 43 of the pyrotechnic actuator. Because of this arrangement the result is an immersion space 42*a* on the right hand side beside the driving piston 44.

32 indicates the central axis of the armature 3. It can be seen clearly that the first pyrotechnic actuation 4*a* is arranged as centrally as possible relative to the center axis 32 on the support 12 to impress the accelerating power impressed by the driving piston 44 as centrally as possible in the armature 3 and to achieve thus a secure, tilting-free operation.

On the right hand side beside the first pyrotechnic actuation, also arranged in the recess 31, there is a first mandrel 33*a*. The way of functioning or employment of this mandrel 33*a* can be seen in particular when both positions according to FIG. 1*a* and FIG. 1*b* are compared.

In the first, fallen-off position according to FIG. 1*a* the first mandrel 33*a*, as part of the armature 3, is shifted relative to the first pyrotechnic actuation 4*a* stationary arranged in the solenoid to the right hand side in such a way that the first mandrel 33*a* does not extend in the immersion space 42*a*.

If in this position the first pyrotechnic actuation 4*a* is activated it would not have any effect as the driving piston 44 driven to the right will not act on the first mandrel in the position shown here, its movement will be decelerated at the end of the housing of the pyrotechnic actuation, that is at the end of the sleeve 43.

The situation in FIG. 1*b*, however, looks different, here the first mandrel 33*a* is shifted to the left in such a way that it penetrates almost completely the immersion space 42. If in this pulled-back position of the armature the first pyrotechnic actuation 4*a* is activated via its trip line 40, 41 the armature would abruptly be shifted to the right, and this is with a much higher speed than the pull-back spring 30 is able to effect.

In the embodiments shown in FIGS. 1*a*, 1*b* another second pyrotechnic actuation is arranged in the center in the armature space floor 36 to the right of the armature 3. This second pyrotechnic actuation is indicated by 4*b*. Its effect is also directed as centrally as possible, in the direction of the central axis 32 of the armature 3. At the armature 3 on its right hand end opposite the armature rod 34 there is a second mandrel 33*b*. This communicates with the immersion space 42*b* of the second pyrotechnic actuation 4*b*.

The active directions of the two pyrotechnic actuations 4*a*, 4*b* are opposed. The active direction of the second pyrotechnic actuation 4*b* is from the right to the left, the one of the first pyrotechnic actuation 4*a* is from the left to the right. The arrangement here is done in such a way that always either of the mandrels 33*a*, 33*b* immerses in the immersion spaces 42*a*, 42*b* of the two pyrotechnic actuations 4*a*, 4*b* communicating with it respectively. The immersion movement (and also the emerging movement) is carried out by the "normal" movement of the armature 3 because of the magnetic attraction forces by current-feeding the coil 2 and the respective reset forces of the reset spring 30.

However, if then an abrupt movement of the armature 3 is required either in the left or right direction, cleverly directly out of the respective position of the armature 3 in the solenoid 1, the respectively suitable pyrotechnic actuation 4*a*, 4*b* is employed.

The arrangement shown here, however, allows even another switching position according to the invention. Basically it is possible that both pyrotechnic actuations 4*a*, 4*b* are ignited at the same time, and the armature 3 is locked in a middle position. It has to be taken into consideration here that the pyrotechnic actuation develops a power much larger than the power of the magnetic field of the coil 2, and thus the armature is fixed. Such a switching position can also be an advantage according to the use of the solenoid.

If FIGS. 1*a* and 1*b* are compared with each other it becomes clear that the armature can be moved in the attracted position as well as in the fallen position each time additionally by the pyrotechnic actuation 4*a*, 4*b*.

In the Figs. identical or corresponding elements are each time indicated with the same reference numbers and therefore are not described anew, if it is not useful.

In FIGS. 2*a*, 2*b*, 2*c* the use of the pyrotechnic actuation 4 is shown clearly.

The solenoid 1 described in FIGS. 2*a*, 2*b*, 2*c* has basically the same construction as in FIGS. 1*a* and 1*b*.

In contrast to the modification according to FIGS. 1*a*, 1*b* only one pyrotechnic actuation 4 is used in FIGS. 2*a*, 2*b*, 2*c*. This is located in the recess 31 of the armature 3.

In FIG. 2*a* the fallen-off position of the solenoid 1 is shown. The pyrotechnic actuation 4 is supported through the support 12 at the housing 10 of the solenoid 1, and is stationary relative to the movement of the armature 3. In the fallen-off position the mandrel 33 does not immerse in the immersion space 42 located at the right end of the pyrotechnic actuation.

The pyrotechnic actuation itself is in the position shown here not yet activated, the driving piston 44 is arranged in the interior of the sleeve 43 in such a way that the immersion space 42 remains.

In FIG. 2*b* the attracted position of the armature 3 is shown. The air gap 37 is closed, the armature 3 shifted to the left, the mandrel 33 moving together with the armature immerses in the immersion space 42. A small gap remains between the front end of the mandrel 33 and the exterior surface of the driving piston 44.

In FIG. 2*c* the pyrotechnic actuation 4 is activated. In a suitable way an activation command has been transmitted via the trip line 40, 41 to the pyrotechnic actuation 4. This has been carried out by the control of the solenoid or the actuating device (not shown here) which contains this solenoid. Because of this activation command an electric or electronic ignitor of the pyrotechnic actuation ignites, the pyrotechnic set explodes and drives with rather high power and abruptly the driving piston 44 to the right in such a way that it bridges here the entire depth of the immersion space 42.

The driving piston 44 is in contact with the mandrel 33 and presses it abruptly to the right, as indicated by arrow 39. The mandrel 33 is pushed out of the immersion space 42 by the driving piston 44, the armature 3 is abruptly brought from the attracted in the fallen-off position, the spring 30 is relaxed in FIG. 2*c*. It might be that here the magnetic field of the coil 2 is not yet completely decayed; nevertheless the armature 3 is already completely shifted to the right pulled back.

In FIGS. 3*a*, 3*b*, 3*c* another modification of a solenoid 1 according to the invention is shown. In FIGS. 2*a*, 2*b*, 2*c* the use of a pyrotechnic actuation is shown, in the sequences in FIGS. 1*a*, 1*b*, on the one hand, and in the FIGS. 3*a*, 3*b*, 3*c*, on the other hand, the use of two pyrotechnic actuations 4, 4*a*, 4*b* is shown. In the embodiment according to FIGS. 1*a*, 1*b* the two pyrotechnic actuations 4*a*, 4*b* are arranged on one side at the armature 3, opposite the armature rod 34. Here about half of the armature 3 immerses in the coil 2. In the embodiments according to FIGS. 3*a*, 3*b*, 3*c* the armature 3 is located between the two pyrotechnic actuations 4*a*, 4*b*.

The way of functioning of the second pyrotechnic actuation 4*b* shown here on the right hand side is very similar to the way of functioning of the second pyrotechnic actuation 4*b* according to FIG. 1*a*. Therefore for a more detailed description it is referred to the description of FIGS. 1*a*, 1*b*.

The first pyrotechnic actuation 4*a* on the left hand side of the armature 3, the armature 3 is located in the embodiment shown here between the two pyrotechnic actuators 4*a*, 4*b*, is designed specially. The pyrotechnic actuation 4*a* shown here comprises two concentric pipe parts 45*a*, 45*b* which themselves enclose the armature rod or the actuator 34.

On the left hand side of the pyrotechnic actuation a suitable annular base is provided connecting the two pipe parts 45*a*, 45*b*. The result is a shell-like volume which is closed on the right hand side by a preferably annular driving piston 44. Here also the arrangement is chosen in such a way that in the non-activated position of the pyrotechnic actuation 4*a* the driving piston 44 is arranged receding so far in the housing that on the right hand side of it a ring- or shell-like immersion space 42 forms.

FIG. 3*a* shows a position where the armature 3 is shifted to the right and the annular mandrel 33*c* is located completely in the armature space 35. The wall thickness of the annular mandrel 33*c* is slightly less than the width of the gap between the two pipe parts 45*a*, 45*b*.

In FIG. 3*b* the armature 3 is shifted to the left in such a way that the mandrel 33*c* immerses in the immersion space 42. The armature rod/actuator 34 is shifted to the left in the same way, the mandrel 33*b* first of all immersed in the immersion space 42*b* at the second pyrotechnic actuation 4*b* is emerged.

In FIG. 3*c* the first pyrotechnic actuation 4*a* is activated in such a way that the annular driving piston 44 is shifted abruptly to the left and, in the same way as in FIG. 2*c*, the annular mandrel 33*c* is pushed away from the left armature space floor 38.

The use of the pyrotechnic actuation is provided, for example, as emergency unlocking or emergency operating, in particular also for abrupt, that means very fast operations of the actuating device or the solenoid according to the invention. Usually a redundancy of such a drive is not provided compulsorily in the device according to the invention (solenoid, actuating device), so that then the exchange of the concerned device is recommandable. Through the control, which is provided for current-feeding coil 2, it is here cleverly provided that it is deactivated when the pyrotechnic actuation is activated or the last functioning pyrotechnic actuation remaining is no longer available (depending on the design of the solenoid according to the invention or the actuating device). Therefore it is clever to provide an arrangement where the pyrotechnic actuation is arranged integrated in the solenoid, or the entire actuating device together with solenoid and (if necessary external) pyrotechnic actuation is integrated, and can thus be easily assembled or removed.

The design of the pyrotechnic actuation is very variable according to the invention. Besides the modification shown in the drawing, where the driving piston does not leave the pyrotechnic actuation or its housing, the invention also comprises those modifications where the driving piston is separated from the housing of the pyrotechnic actuation when the pyrotechnic actuation is activated.

Although the invention has been described by exact examples which are illustrated in the most extensive detail it is pointed out that this only for illustration purpose, and the invention is not necessarily limited to it because alternative embodiments and methods become clear for experts in view of the disclosure. Accordingly changes can be considered which can be made without departing from the contents of the described invention.

The invention claimed is:

1. Solenoid comprising a coil which can be electrified, an armature movable by a resulting magnetic field created by the coil, an operating member acted on by the armature, and at least one pyrotechnic actuation for the armature or the operating member, the at least one pyrotechnic drive being arranged in one of the armature and the operating member, wherein the at least one pyrotechnic actuation having a sleeve in which a drive piston is arranged which is moved by a pyrotechnic set of the at least one pyrotechnic actuation, and in a not-activated position of the at least one pyrotechnic actuation in the sleeve in front of a drive piston an immersion space is provided.

2. Solenoid according to claim 1, wherein in the armature or the operating member a recess is provided in which the at least one pyrotechnic actuation is arranged, and the armature or the operating member moves relative to the at least one pyrotechnic actuation by feeding of current to the coil, and/or the at least one pyrotechnic actuation is supported by a housing or a form of the coil.

3. Solenoid according to claim 1, wherein the at least one pyrotechnic actuator moves together with the armature or the operating member, and/or the at least one pyrotechnic actuation acts as centrically as possible with regard to the armature or the operating member.

4. Solenoid according to claim 1, wherein at least one trip line is connected with a control to the at least one pyrotechnic actuation and/or a control also controls flow of current through the coil.

5. Solenoid according to claim 1, wherein active direction of the at least one pyrotechnic actuation is opposed to a direction of movement of the armature moved by the magnetic field of the coil.

6. Solenoid according to claim 1, wherein a spring against a spring force of which the armature is attracted when the coil is current-fed.

7. Solenoid according to claim 1, wherein the at least one pyrotechnic actuation is arranged in an armature space laterally beside the armature, and/or two pyrotechnic actuations are provided with respective effective directions of which are opposed.

8. Solenoid according to claim 1, wherein two pyrotechnic actuations are provided with respective effective directions of which are opposed, and both of the two pyrotechnic actuations move together at the armature or at least one of the two pyrotechnic actuations is stationary, and/or the armature is located between the two pyrotechnic actuations.

9. Solenoid according to claim 1, wherein the armature acts on the operating member on a first side or is connected with it, and two pyrotechnic actuations are arranged on a backside of the armature opposing the first side.

10. Method for the operation of a solenoid according to claim 1, wherein after activating the at least one pyrotechnic actuation, another current-feeding of the coil is interrupted.

* * * * *